US009676505B2

(12) United States Patent
Robinson et al.

(10) Patent No.: US 9,676,505 B2
(45) Date of Patent: Jun. 13, 2017

(54) TWISTER ASSEMBLY FOR GRIPPING, CUTTING, TWISTING, AND EJECTING A LENGTH OF WIRE AROUND ONE OR MORE OBJECTS AND METHODS TO USE THE SAME

(71) Applicant: Enterprises International, Inc., Hoquiam, WA (US)

(72) Inventors: Darrell Robinson, Montesano, WA (US); Donald Smith, Aberdeen, WA (US); Lyndon Cozzutto, Aberdeen, WA (US); David Doyle, Aberdeen, WA (US); Philip Floyd Jones, Hoquiam, WA (US)

(73) Assignee: Enterprises International, Inc., Hoquiam, WA (US)

( * ) Notice: Subject to any disclaimer, the term of this patent is extended or adjusted under 35 U.S.C. 154(b) by 882 days.

(21) Appl. No.: 13/941,293

(22) Filed: Jul. 12, 2013

(65) Prior Publication Data

US 2014/0013968 A1 Jan. 16, 2014

Related U.S. Application Data

(60) Provisional application No. 61/671,034, filed on Jul. 12, 2012, provisional application No. 61/818,368, filed on May 1, 2013.

(51) Int. Cl.

| | |
|---|---|
| ***B65B 13/04*** | (2006.01) |
| ***B65B 13/28*** | (2006.01) |
| ***B65B 13/06*** | (2006.01) |
| ***B65B 13/22*** | (2006.01) |

(52) U.S. Cl.
CPC ..... *B65B 13/04* (2013.01); *B65B 13/06* (2013.01); *B65B 13/22* (2013.01); *B65B 13/28* (2013.01)

(58) Field of Classification Search
CPC ..... B65B 13/04; B65B 13/06; B65B 13/22; B65B 13/28; B65B 27/06
USPC ..... 100/31; 140/93.6, 118, 149
See application file for complete search history.

(56) References Cited

U.S. PATENT DOCUMENTS

| | | | |
|---|---|---|---|
| 1,486,396 | A | 3/1924 | Ingold |
| 3,146,695 | A | 9/1964 | Van De Bilt |
| 3,179,037 | A | 4/1965 | Cranston, Jr. et al. |
| 3,327,618 | A | 6/1967 | Cook |

(Continued)

FOREIGN PATENT DOCUMENTS

| | | | |
|---|---|---|---|
| GB | 2267075 | A | 11/1993 |
| WO | 2010/001345 | A2 | 1/2010 |

*Primary Examiner* — Jimmy T Nguyen
(74) *Attorney, Agent, or Firm* — Seed IP Law Group LLP

(57) ABSTRACT

A twister assembly for use in connection with bundling one or more objects with a length of wire may cut, grip, eject, and twist the length of wire. The twister assembly includes a main shaft driven by a main shaft motor and a twister shaft driven by a twister motor. The main shaft may be operatively coupled to a gripping mechanism, which is operable between an open and a closed position, a cutting mechanism, and an ejector mechanism. The twister shaft may be operatively coupled to a twisting mechanism, where the twisting mechanism includes a plurality of gears configured to rotate a twister pinion. The twister pinion is further configured to engage the length of wire and twist a portion of the length of wire to form a knot. Related twister assemblies and methods are also provided.

17 Claims, 9 Drawing Sheets

(56) References Cited

U.S. PATENT DOCUMENTS

| | | | | |
|---|---|---|---|---|
| 3,447,448 | A | 6/1969 | Pasic | |
| 3,759,169 | A | 9/1973 | Goodley | |
| 3,831,512 | A | 8/1974 | Johnson | |
| 3,889,584 | A | 6/1975 | Wiklund | |
| 4,403,542 | A | 9/1983 | Lewis | |
| 4,450,763 | A | 5/1984 | Saylor | |
| 4,498,379 | A | 2/1985 | Saylor | |
| 4,520,720 | A | 6/1985 | Urban et al. | |
| 4,711,071 | A | 12/1987 | Kagi | |
| 5,333,438 | A | 8/1994 | Gurak et al. | |
| 5,916,108 | A | 6/1999 | Drietz et al. | |
| 6,499,525 | B1 | 12/2002 | Lai | |
| 6,584,891 | B1 | 7/2003 | Smith et al. | |
| 2003/0024404 | A1 | 2/2003 | Daniel et al. | |
| 2003/0121424 | A1* | 7/2003 | Doyle | B65B 13/06 100/29 |
| 2005/0224131 | A1* | 10/2005 | Ishii | B65B 13/187 140/2 |

* cited by examiner

TWISTER ASSEMBLY FOR GRIPPING, CUTTING, TWISTING, AND EJECTING A LENGTH OF WIRE AROUND ONE OR MORE OBJECTS AND METHODS TO USE THE SAME

CROSS-REFERENCE TO RELATED APPLICATION

This application claims the benefit under 35 U.S.C. §119 (e) of U.S. Provisional Patent Application No. 61/671,034, filed Jul. 12, 2012, and U.S. Provisional Patent Application No. 61/818,368, filed May 1, 2013, and where these provisional applications are incorporated herein by reference in their entirety.

BACKGROUND

Technical Field

The present disclosure relates to wire-tying assemblies for bundling one or more objects and, more particularly, to twister assemblies for gripping, cutting, twisting, and ejecting a length of wire around a bundle of one or more objects.

Description of the Related Art

U.S. Pat. No. 6,584,891 ('891 patent) issued to Smith et al. teaches apparatuses and methods for wire-tying one or more objects and is incorporated herein by reference in its entirety. The '891 patent teaches a twister assembly that is operable by a single twister motor. More particularly, a main shaft of the single twister motor is mounted with multi-purpose cams and a drive gear, among others, that allows the twister assembly to guide, grip, twist, cut, and eject a length of wire used to bundle one or more objects.

BRIEF SUMMARY

This application is an improvement over U.S. Pat. No. 6,584,891. Embodiments described herein provide twister assemblies and methods for gripping, cutting, twisting, and ejecting a length of wire around a bundle of one or more objects, and methods to use the same. According to one embodiment, a twister assembly for use in connection with bundling one or more objects with a length of wire may be summarized as including: a main shaft driven by a main shaft motor and a twister shaft driven by a twister motor. The main shaft is operatively coupled to a gripping mechanism operable between an open and a closed position, wherein the gripping mechanism is selectively configured to be in the open position during feed of the length of wire and, wherein, the gripping mechanism is selectively configured to be in the closed position during tensioning of the length of wire; a cutting mechanism configured to cut the length of wire positioned within the twister assembly; and an ejector mechanism configured to eject the length of wire from the twister assembly. The twister shaft is operatively coupled to a twisting mechanism, the twister motor being controllable independent from the main shaft motor, the twisting mechanism including a plurality of gears configured to rotate a twister pinion, the twister pinion engaging the length of wire and twisting a portion of the length of wire to form a knot.

According to another embodiment, a twister assembly for gripping, twisting, cutting, and ejecting a length of wire used in connection with bundling one or more objects may be summarized as including: a main shaft driven by a main shaft motor, the main shaft including a gripper cam, a cutter cam, and an ejector cam; and a twister shaft driven by a twister motor. The gripper cam actuates a gripping mechanism operable between an open and a closed position, wherein the gripping mechanism is selectively configured to be in the open position during feed of the length of wire and, wherein, the gripping mechanism is selectively configured to be in the closed position during tensioning of the length of wire. The cutter cam actuates a cutting mechanism configured to cut the length of wire positioned within the twister assembly. The ejector cam actuates an ejector mechanism configured to eject the length of wire from the twister assembly. The twister motor is controllable independent of the main shaft motor and includes a drive gear coupled thereto. The drive gear actuates a twisting mechanism, the twisting mechanism including a plurality of idler gears driven by the drive gear, the plurality of idler gears configured to rotate a twister pinion engageable with the length of wire to twist a portion of the length of wire to form a knot.

According to yet another embodiment, a method for gripping, twisting, cutting, and ejecting a length of wire using a twister assembly having a main shaft and a twister shaft may be summarized as including: rotating the main shaft of the twister assembly to actuate a gripper cam, the actuation of the gripper cam activating a gripping mechanism to allow tensioning of the length of wire; rotating the twister shaft of the twister assembly to actuate a twisting mechanism, the twisting mechanism twisting a portion of the length of wire to tie a knot; rotating the main shaft of the twister assembly to actuate a cutter cam, the actuation of the cutter cam activating a cutting mechanism to cut the length of wire positioned within the twister assembly; and rotating the main shaft of the twister assembly to actuate an ejector cam, the actuation of the ejector cam activating an ejector mechanism to eject the length of wire from the twister assembly.

DETAILED DESCRIPTION

The following detailed description is directed toward twister assemblies for cutting, gripping, ejecting, and twisting the ends of a length of wire wrapped around a bundle of one or more objects positioned in a bundling station and methods to use the same. The following detailed description and corresponding figures are intended to provide an individual of ordinary skill in the art with enough information to enable that individual to make and use embodiments of the invention. Such an individual, however, having read this entire detailed description and reviewed the figures, will appreciate that modifications can be made to the illustrated and described embodiments, and/or elements removed therefrom, without deviating from the spirit of the invention. It is intended that all such modifications and deviations fall within the scope of the invention, to the extent they are within the scope of the associated claims.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1A:
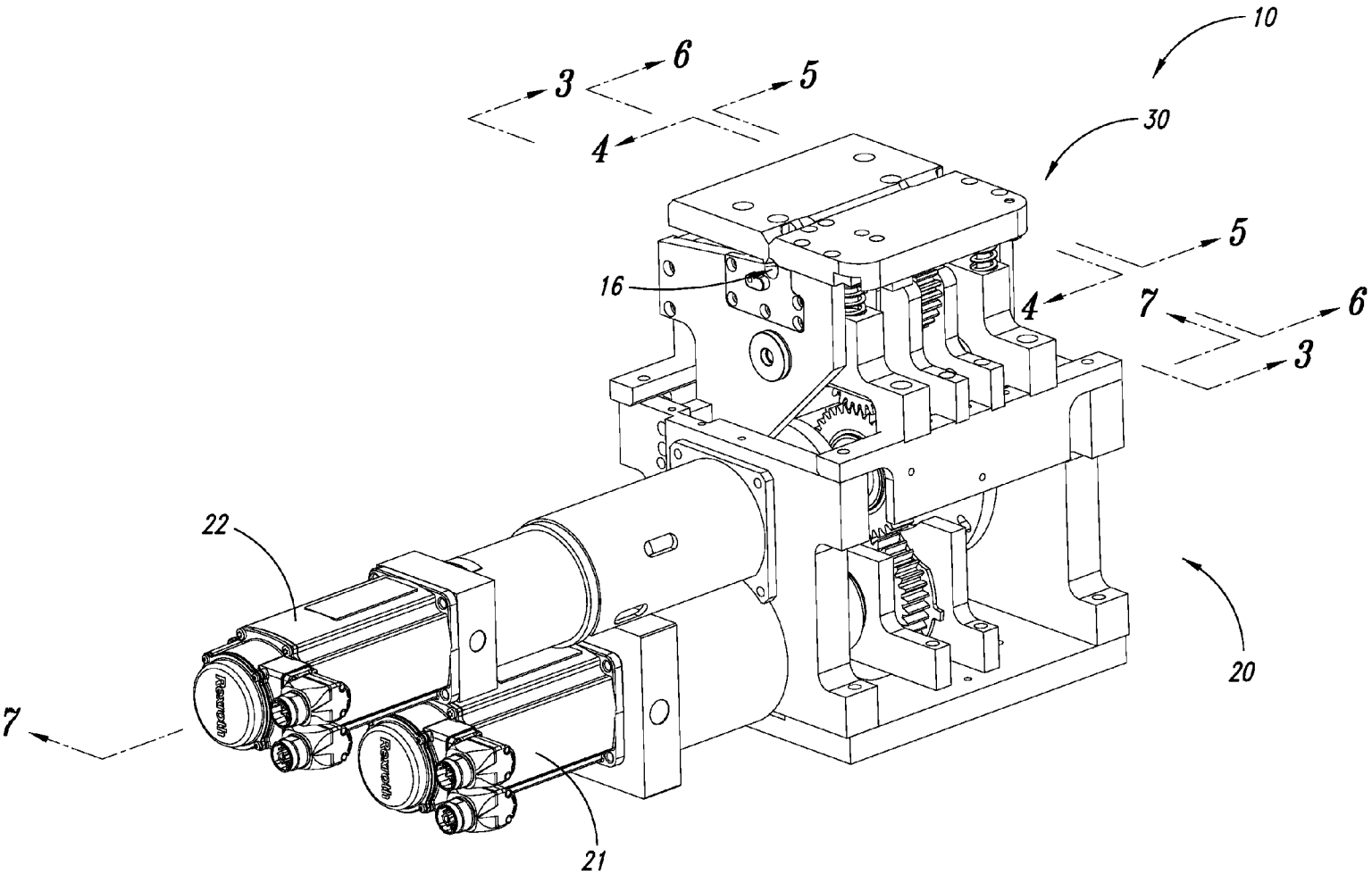
FIG. 1A is an isometric view of a twister assembly, according to one embodiment.
Figure 1B:
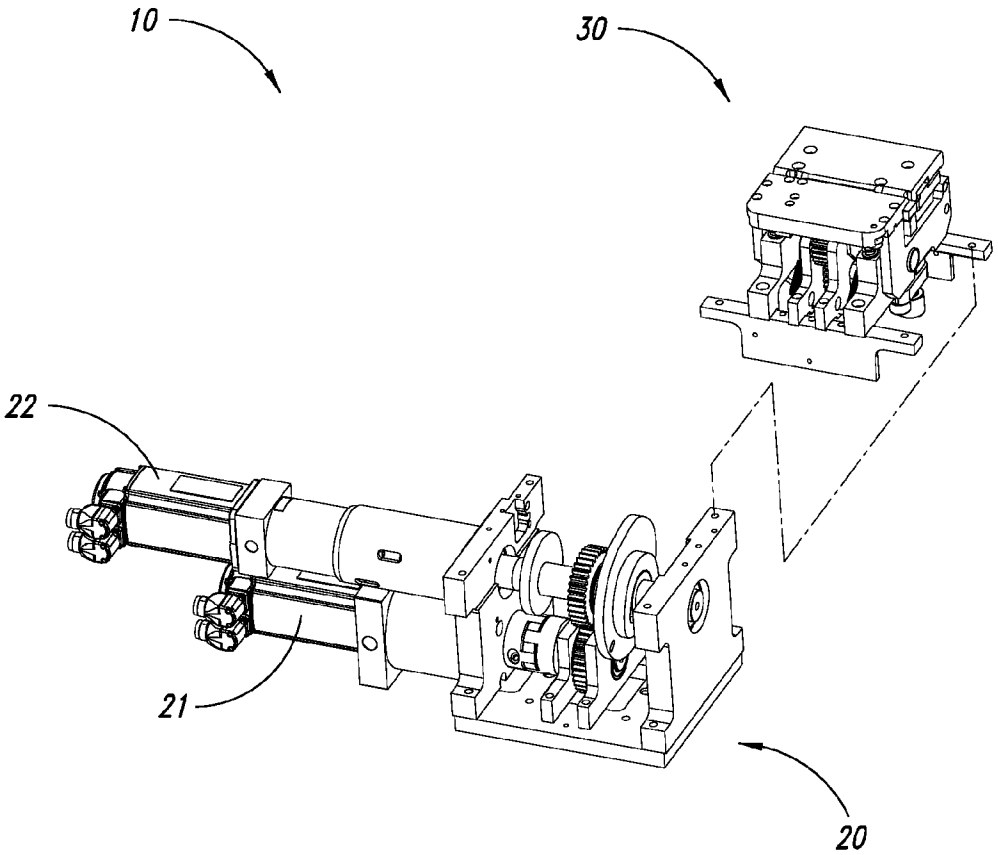
FIG. 1B is a partially exploded isometric view of the twister assembly of FIG. 1A.

FIGS. 1A and 1B illustrate a twister assembly 10, according to one embodiment. The twister assembly 10 primarily includes a lower twister assembly 20 and an upper twister assembly 30. The upper twister assembly 30 is coupled to the lower twister assembly 20 to form the twister assembly 10. The upper twister assembly 30 may be coupled to the lower twister assembly 20 through fasteners, welding, or the like. The twister assembly 10 performs several functions of a wire tying machine, explained in more detail elsewhere. The twister assembly 10 includes a twister entry 16 that receives a length of wire 102 (FIG. 7) to be gripped, twisted, cut, and ejected after the length of wire 102 has been tied around a bundle of one or more objects positioned in a bundling station.

Figure 2A:
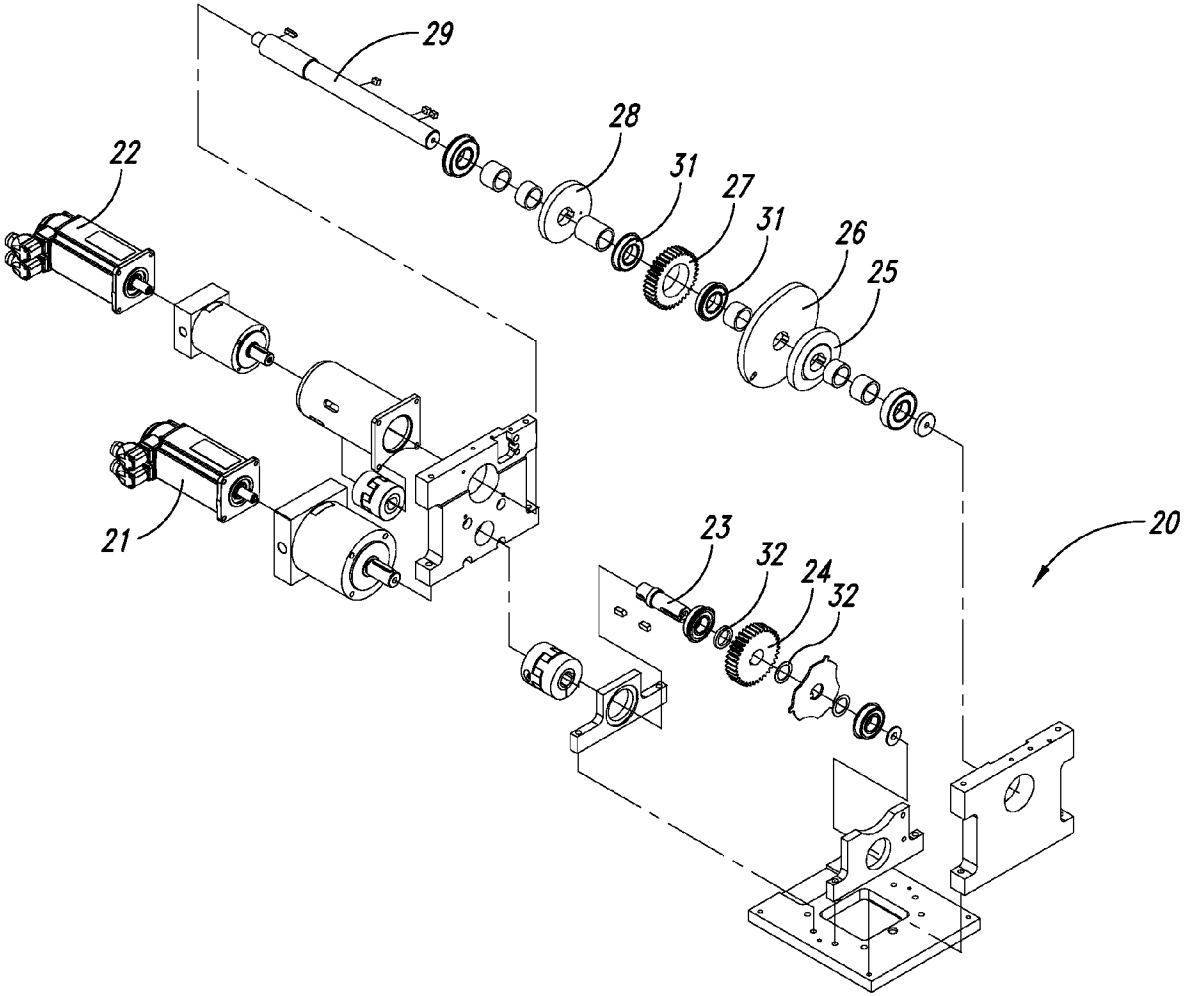
FIG. 2A is an exploded isometric view of a lower portion of the twister assembly of FIG. 1A.

With reference to FIGS. 1A, 1B, and 2A, the lower twister assembly 20 includes an independently driven twister motor 21 and an independently driven main shaft motor 22. The main shaft motor 22 drives a main shaft 29, which includes a cutter cam 28, an ejector cam 26, and a gripper cam 25 mounted thereto. The main shaft 29 also includes a main shaft idler gear 27 secured to the main shaft 29 with a pair of bearings 31 in a known manner, such that the main shaft 29 does not drive the main shaft idler gear 27. The twister motor 21 drives a twister shaft 23, which includes a drive gear 24 coupled thereto through a pair of ball bearings 32.

Figure 2B:
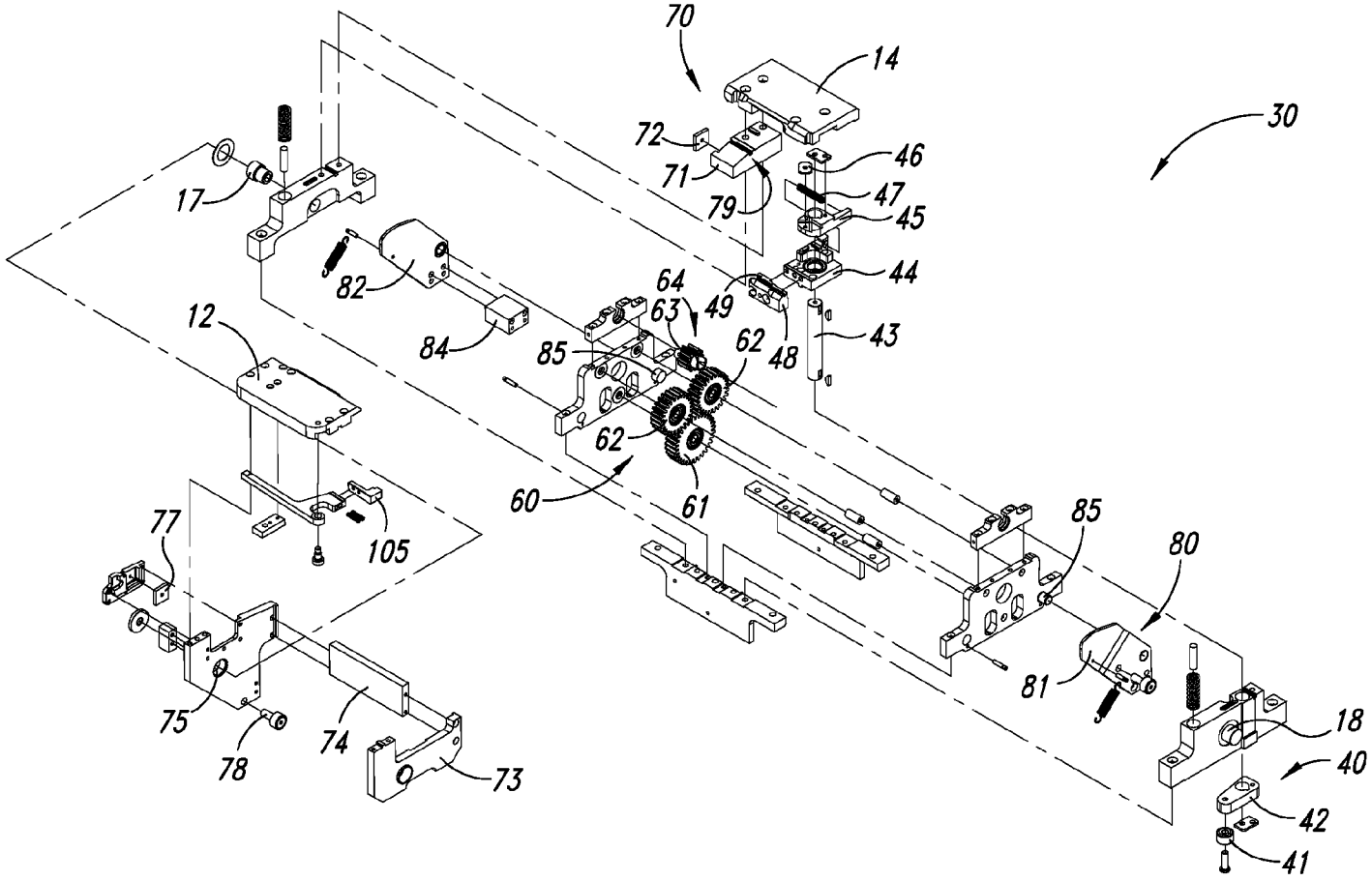
FIG. 2B is an exploded isometric view of an upper portion of the twister assembly of FIG. 1A.

With reference to FIGS. 1A, 1B, and 2B, the upper twister assembly 30 includes a gripper subassembly 40, a twisting subassembly 60, a cutter subassembly 70, and an ejector subassembly 80. The gripper subassembly 40 is operable between a closed and an open position. The gripper subassembly includes a gripper insert 48 coupled to a gripper base 44. The gripper insert 48 includes a gripper groove 49 to allow the length of wire 102 to pass through, as the length of wire 102 passes through the twister assembly 10. A gripper lever 45 is coupled to the gripper base 44 and is biasingly positioned to be in the closed position through a spring 47 coupled to the gripper base 44 and the gripper lever 45.

Figure 5:
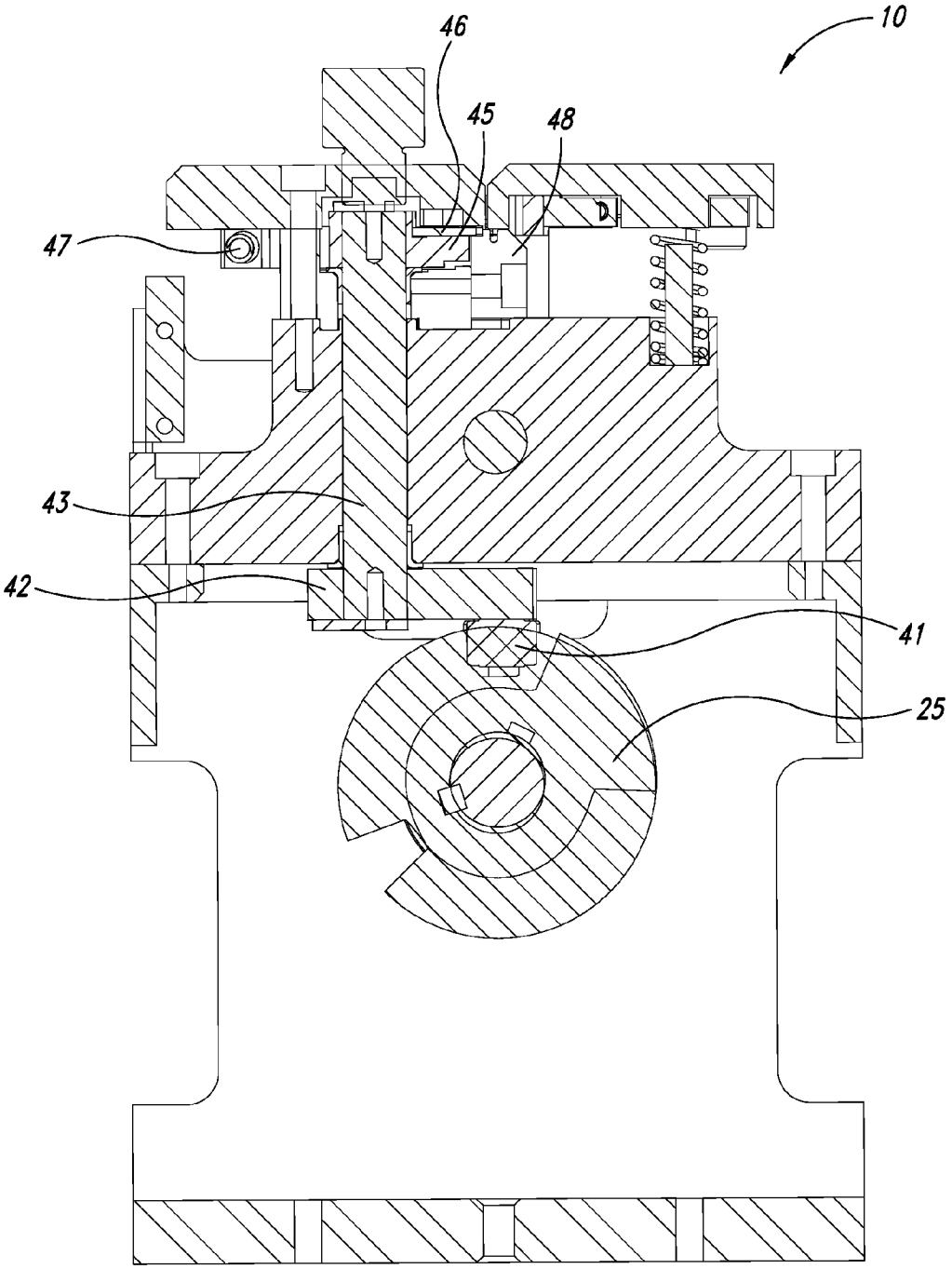
FIG. 5 is a right elevational cross-sectional view of the twister assembly of FIG. 1, taken along line 5-5, of FIG. 1A.

As best seen in FIGS. 2B and 5, the gripper lever 45 is pivotally coupled to a gripper follower arm 42 through a gripper shaft 43. The gripper follower arm 42 is further coupled to a gripper cam roller 41. The gripper lever 45 operates between the closed and open positions as the gripper cam 25 is activated. Prior to a feed cycle, where the length of wire 102 is guided around the one or more objects to be bundled, the main shaft 29 rotates to a home position, activating the gripper cam 25. As the main shaft 29 rotates from the home position, the gripper cam 25 rotates along with the main shaft 29, and actuates the gripper cam roller 41, causing a gripper shaft 43 coupled to the gripper cam roller 41 to rotate. The rotation of the gripper shaft 43 causes the gripper lever 45 to pivotally rotate about the gripper shaft 43 to move the gripper lever 45 to the open position. In the open position, a gripping plate 46 moves away from the gripper groove 49, thereby allowing the length of wire 102 to pass through freely during the feed cycle. As the main shaft 29 continues to rotate, the gripper cam 25, the gripper cam roller 41, the gripper follower arm 42, and the gripper shaft 43 cooperatively rotate to move the gripper lever 45 back to the closed position, allowing the gripping plate 46 to grip the length of wire 102 during a tension cycle. The gripper subassembly 40 being operable between open and closed positions advantageously reduces wire shavings and reduces wear on the gripper insert 48, as the gripping plate 46 moves away from the gripper insert 48 during the feed cycle.

Figure 6:
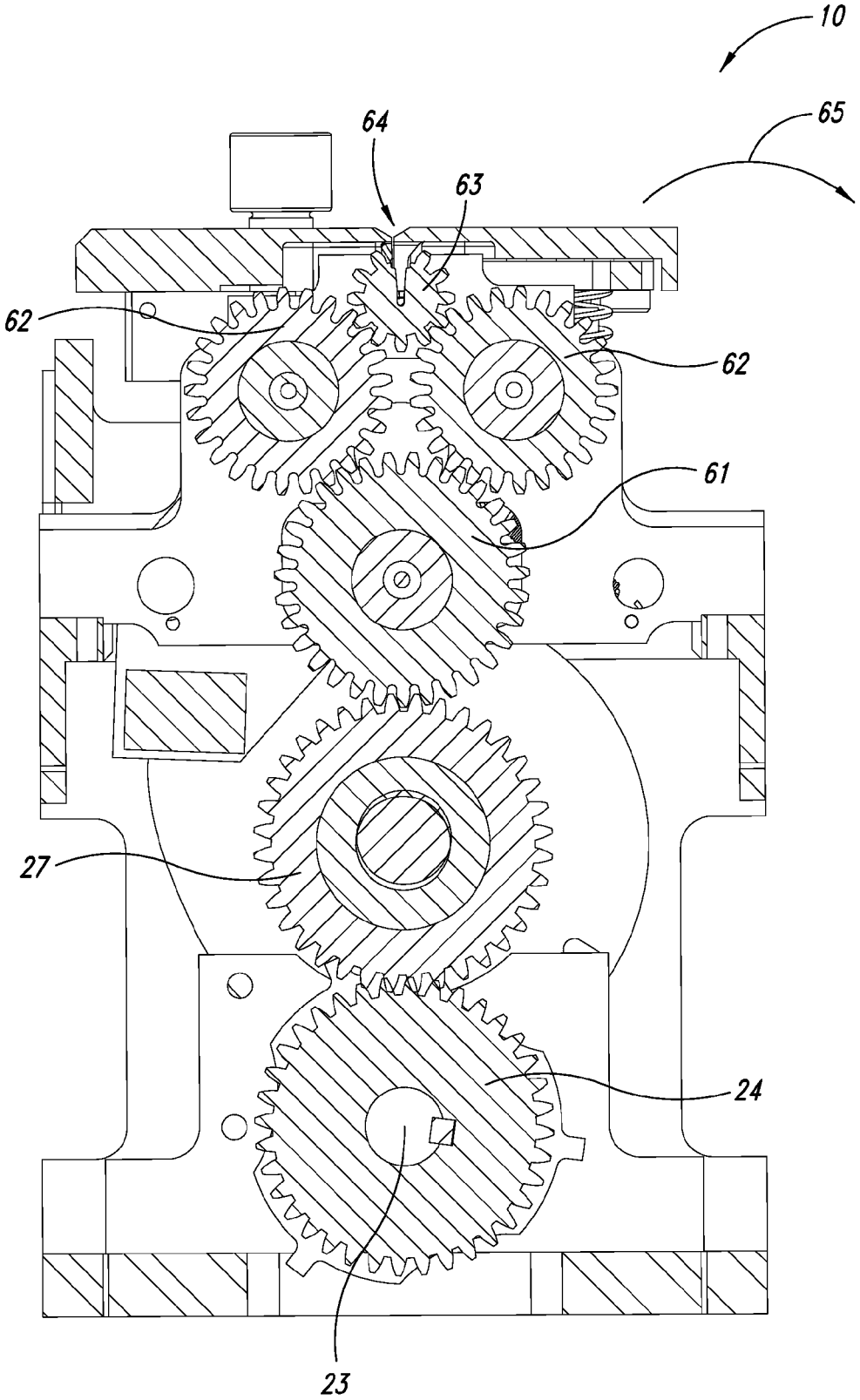
FIG. 6 is a right elevational cross-sectional view of the twister assembly of FIG. 1, taken along line 6-6, of FIG. 1A.

With reference to FIGS. 1A, 2A, 2B, and 6, the twisting subassembly 60 includes a top twister idler gear 61 engageably coupled to a pair of top idler gears 62. The top idler gears 62 are symmetrical and engageably coupled to a twister pinion 63, which includes a slot 64 to allow the length of wire 102 to pass therethrough. As best seen in FIG. 6, the twister shaft 23 drives a twister drive gear 24. The twister drive gear 24 is engageably coupled to the main shaft idler gear 27 which, in turn, is engageably coupled to the top twister idler gear 61. As the twister shaft 23 rotates the twister drive gear 24, the engageably coupled idler gears 61, 62 are configured to rotate the twister pinion 63 in the direction 65 illustrated in FIG. 6.

With reference to FIGS. 1A, 2A, 2B, and 3, the cutter subassembly 70 includes a first cutter insert 77 coupled to a left-hand rocker arm 75. The left-hand rocker arm 75 is further coupled to a right-hand rocker arm 73 through a connector plate 74. The left-hand rocker arm 75 and the right-hand rocker arm 73 pivot on a pivot block shaft 17 and a rocker shaft 18. The cutter subassembly 70 further includes a cutter guide block 71, which is positioned proximate to the twister entry 16 and includes a second cutter insert 72 attached thereto. The cutter guide block 71 further includes a cutter groove 79 to allow the length of wire 102 to enter and pass through the twister assembly 30.

Figure 3:
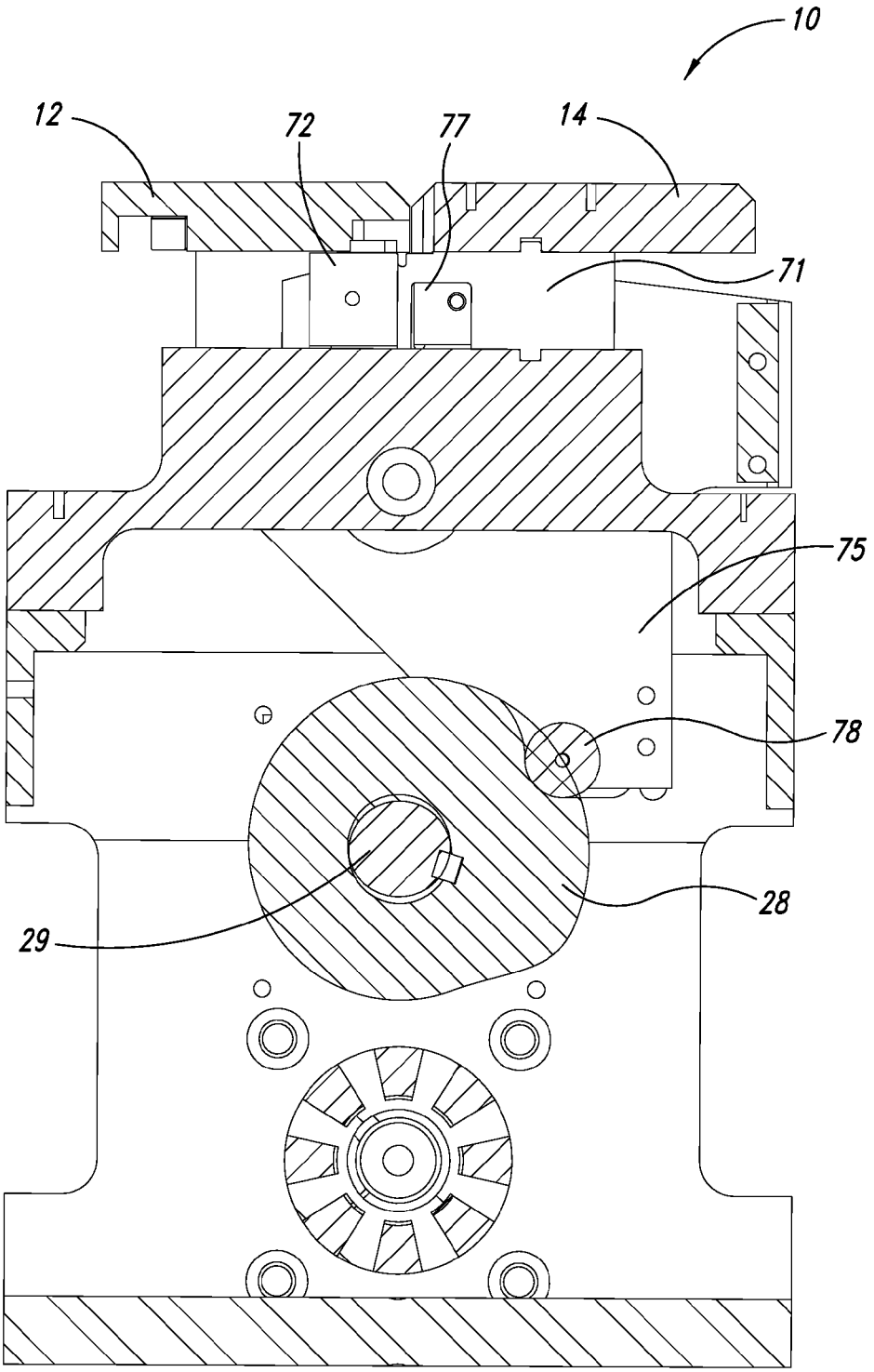
FIG. 3 is a right elevational cross-sectional view of the twister assembly of FIG. 1, taken along line 3-3, of FIG. 1A.

As best seen in FIG. 3, a cutter cam roller 78 is coupled to the left-hand rocker arm 75. As the main shaft 29 rotates, the cutter cam 28 rotates along with the main shaft 29, and actuates the cutter cam roller 78. The actuation of the cutter cam roller 78 further actuates the left-hand rocker arm 75 relative to the cutter guide block 71, causing the length of wire 102 to be sheared off between the first cutter insert 77 and the second cutter insert 72.

With continued reference to FIGS. 1A, 2A, 2B, and 3, a moving cover 12 is pivotally coupled to the left-hand rocker arm 75 and the right-hand rocker arm 73, and is positioned adjacent to a fixed cover 14. The actuation of the cutter cam roller 78 in the manner described above, resulting in the pivoting rotation of the left-hand rocker arm 75 and the right-hand rocker arm 73, also causes the moving cover 12 to move away from the fixed cover 14, thus allowing the length of wire 102 to be released from the twister assembly 30.

With reference to FIGS. 1A, 2A, 2B, and 4, the ejector subassembly 80 includes a right-hand ejector plate 81 and a left-hand ejector plate 82. The right-hand and left-hand ejector plates 81, 82 are coupled to each other through a rigid ejector connector plate 84, so the right-hand and left-hand ejector plates 81, 82 can move together. The right-hand and left-hand ejector plates 81, 82 pivot about ejector shafts 85 that are coupled to each other and extend from the right-hand ejector plate 81 to the left-hand ejector plate 82.

Figure 4:
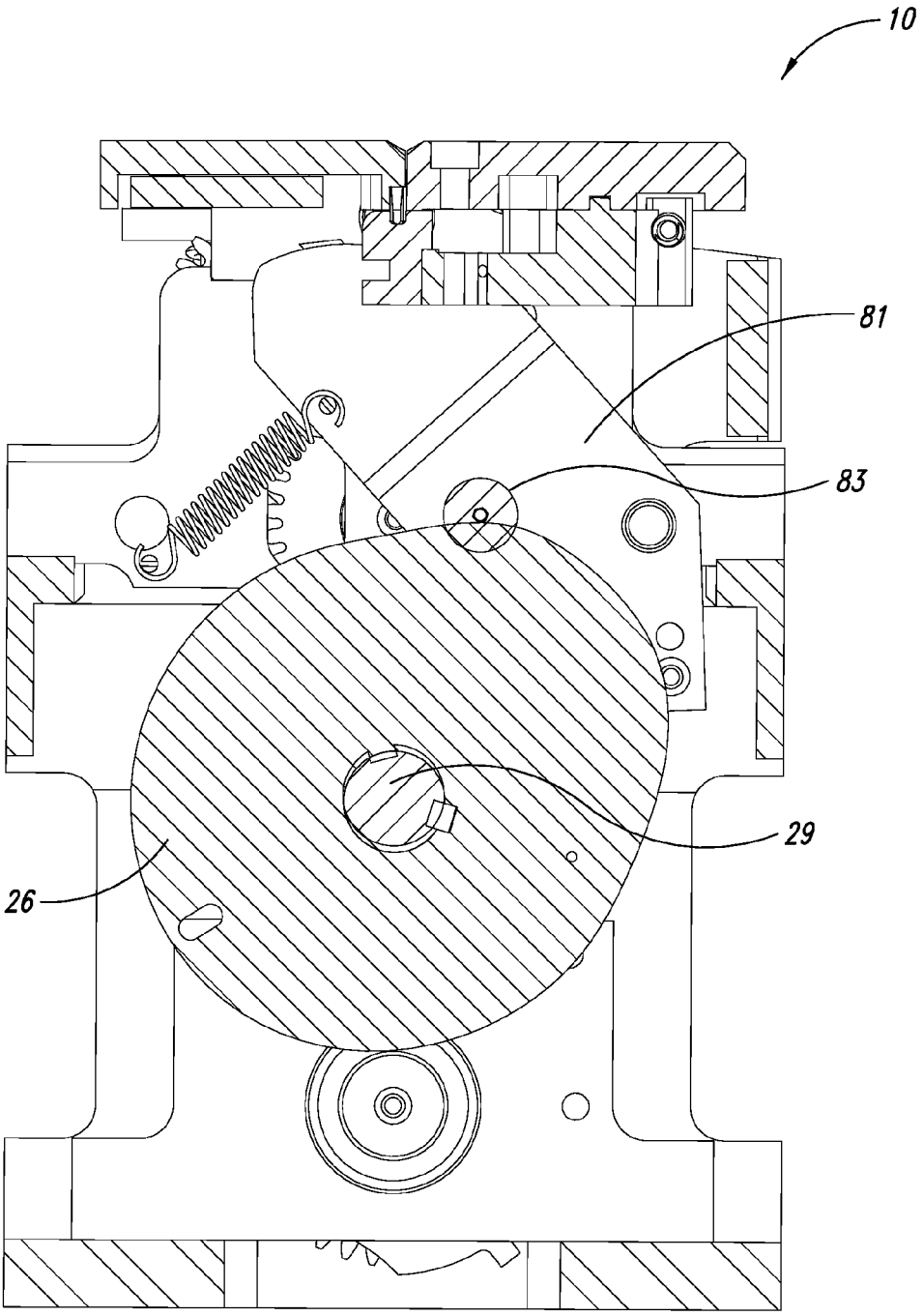
FIG. 4 is a right elevational cross-sectional view of the twister assembly of FIG. 1, taken along line 4-4, of FIG. 1A.

As best seen in FIG. 4, an ejector cam roller 83 is coupled to the right-hand ejector plate 81. As the main shaft 29 rotates, the ejector cam 26 rotates along with the main shaft 29, and actuates the ejector cam roller 83. The actuation of the ejector cam roller 83 raises the right-hand and left-hand ejector plates 81, 82, causing the right-hand and left-hand ejector plates 81, 82 to push the length of wire 102 out of the twister assembly 30.

Figure 7:
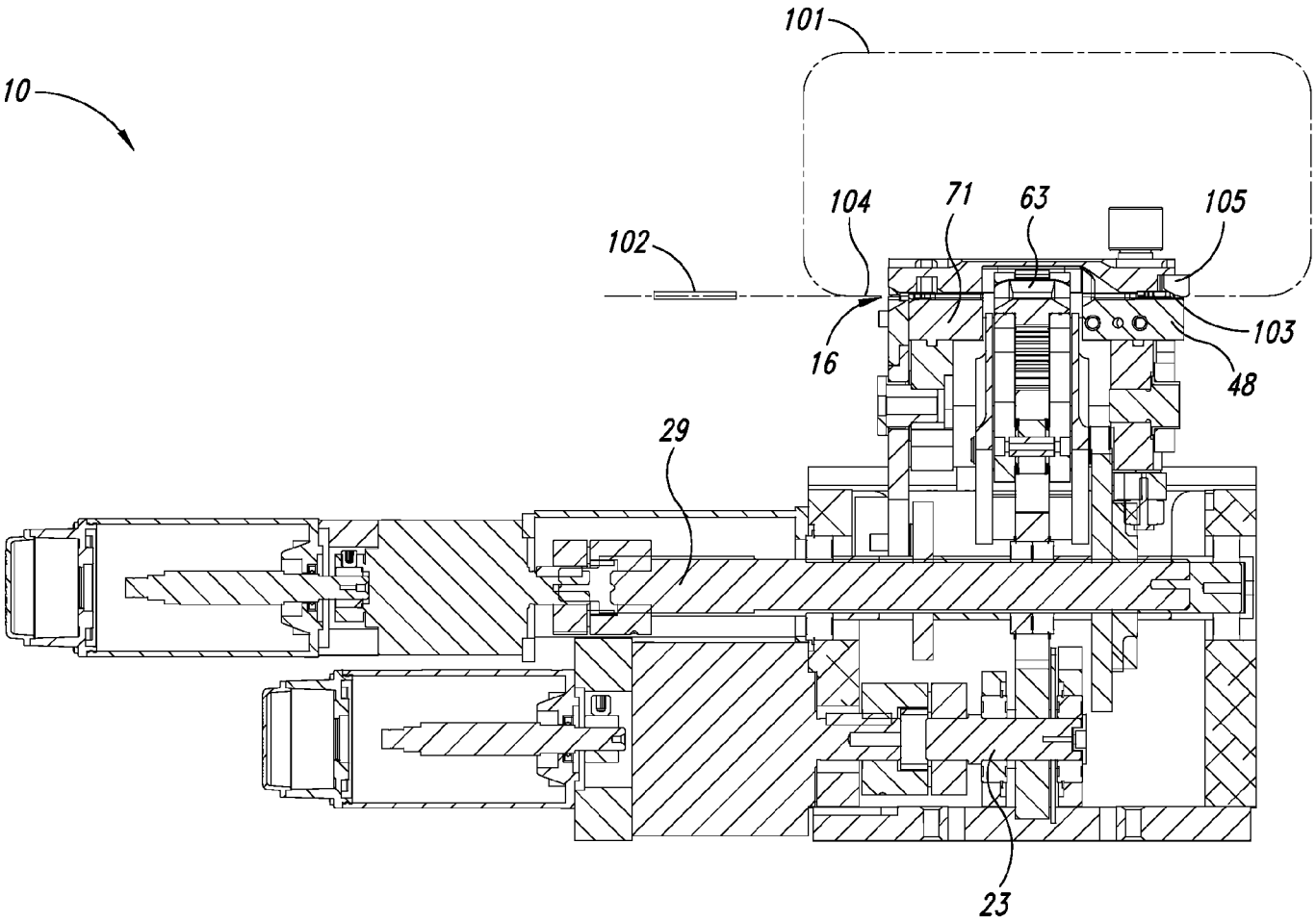
FIG. 7 is a side cross-sectional view of the twister assembly of FIG. 1A, taken along line 7-7, of FIG. 1A.

In use, as discussed earlier, prior to the feed cycle, the main shaft 29 rotates to the home position and activates the gripper cam 25, to move the gripper lever 45 into the open position. As best seen in FIG. 7, during the feed cycle, the free end of the length of wire 102 enters the twister assembly 30 through the twister entry 16. The free end then passes through the cutter groove 79 of the cutter guide block 71, through the slot 64 of the twister pinion 63, and through the gripper groove 49 of the gripper insert 48. The free end then exits the twister assembly 30 to travel around a track assembly along a wire guide path 101 and then re-enters the twister assembly 30 through the twister entry 16. The free end passes through the cutter groove 79 of the cutter guide block 71, through the slot 64 of the twister pinion 63, and through the gripper groove 49 of the gripper insert 48, with the upper length of wire 104 now positioned above the lower length of wire 103, and stops upon contacting a stop block 105. The gripper cam 25 is then actuated to move the gripper lever 45 into the closed position, thereby gripping the upper length of wire 104 through the gripping plate 46. The gripping of the upper length of wire 104 allows the lower length of wire 103 to be tensioned by a feed and tension unit in a known manner.

After tensioning of the length of wire 102 is complete, the twister motor 21 rotates the twister shaft 23 and activates the twisting subassembly 60 in order to tie a knot between the upper length of wire 104 and the lower length of wire 103. During the twisting operation, the rotation of the twister pinion 63 twists the upper and lower length of wires 104, 103 to form a knot. After the upper and lower length of wires 104, 103 are twisted to form one complete knot, the independently operated twister motor 21 may further twist the upper and lower length of wires 104, 103 to form an over-twist knot, which can include a further quarter turn. The independent operation of the twister motor 21 advantageously allows for controlling the number of twists that form the knot and also allows for an over-twisted knot, which relieves the stress in the knot, improves the knot integrity, and improves the ejection of the knot from the twister pinion 63.

After the twisting operation is completed, the rotation of the main shaft 29 rotates the cutter cam 28 to actuate the cutter cam roller 78, which rotates the right-hand and left-hand rocker arms 73, 75. The rotation of the right-hand and left-hand rocker arms 73, 75 allows the length of wire 102 to be sheared off between the first cutter insert 77 and the second cutter insert 72, and also moves the moving cover 12 away from the fixed cover 14.

After the length of wire 102 is sheared off, the rotation of the main shaft 29 rotates the ejector cam 26, which actuates the ejector cam roller 83. Actuating the ejector cam roller 83 raises the right-hand and left-hand ejector plates 81, 82, which pushes the length of wire 102 and the knot out of the twister pinion 63, lifting the length of wire 102 loop free from the twister assembly 30.

Moreover, the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A twister assembly for use in connection with bundling one or more objects with a length of wire, the twister assembly comprising:

a main shaft driven by a main shaft motor and operatively coupled to:

a gripping mechanism operable between an open and a closed position, wherein the gripping mechanism is selectively configured to be in the open position during feed of the length of wire and, wherein, the gripping mechanism is selectively configured to be in the closed position during tensioning of the length of wire, wherein the gripping mechanism includes a gripper cam rotatably driven by the main shaft, the gripper cam being engageable with a gripper cam roller coupled to a gripper shaft, rotation of the gripper cam activating a gripper lever coupled to the gripper shaft such that the gripper lever is moveable to the open position to allow the length of wire to pass through and to the closed position to grip the length of wire;

a cutting mechanism configured to cut the length of wire positioned within the twister assembly; and an ejector mechanism configured to eject the length of wire from the twister assembly; and a twister shaft driven by a twister motor and operatively coupled to a twisting mechanism, the twister motor being controllable independent from the main shaft motor, the twisting mechanism including a plurality of gears configured to rotate a twister pinion, the twister pinion engaging the length of wire and twisting a portion of the length of wire to form a knot.

2. A twister assembly for use in connection with bundling one or more objects with a length of wire, the twister assembly comprising:

a main shaft driven by a main shaft motor and operatively coupled to:

a gripping mechanism operable between an open and a closed position, wherein the gripping mechanism is selectively configured to be in the open position during feed of the length of wire and, wherein, the gripping mechanism is selectively configured to be in the closed position during tensioning of the length of wire;

a cutting mechanism configured to cut the length of wire positioned within the twister assembly; and an ejector mechanism configured to elect the length of wire from the twister assembly; and a twister shaft driven by a twister motor and operatively coupled to a twisting mechanism, the twister motor being controllable independent from the main shaft motor, the twisting mechanism including a plurality of gears configured to rotate a twister pinion, the twister pinion engaging the length of wire and twisting a portion of the length of wire to form a knot, wherein the plurality of gears includes:

a drive gear rotatably driven by the twister shaft;

a main shaft drive gear rotatably engageable with the drive gear and driven by the twister shaft;

a lower idler gear rotatably engageable with the main shaft drive gear; and a pair of upper idler gears rotatably engageable with the lower idler gear and the twister pinion, such that rotation of the pair of upper idler gears actuates the twister pinion to form the knot.

3. The twister assembly of claim 1 wherein the twister pinion is slotted to allow the length of wire to pass therethrough.

4. The twister assembly of claim 1 wherein the twisting mechanism is adjustable to selectively increase a number of twists of the portion of the length of wire forming the knot.

5. The twister assembly of claim 1 wherein the twisting mechanism is configured to overtwist the portion of the length of wire forming the knot.

6. The twister assembly of claim 1 wherein the gripper cam roller is coupled to a gripper cam follower arm, the gripper cam follower arm being pivotally coupled to the gripper shaft to activate the gripper lever to move to the open position to allow the length of wire to pass through and to the closed position to grip the length of wire.

7. A twister assembly for use in connection with bundling one or more objects with a length of wire, the twister assembly comprising:

a main shaft driven by a main shaft motor and operatively coupled to:

a gripping mechanism operable between an open and a closed position, wherein the gripping mechanism is selectively configured to be in the open position during feed of the length of wire and, wherein, the gripping mechanism is selectively configured to be in the closed position during tensioning of the length of wire, wherein the gripping mechanism includes a gripper cam rotatably driven by the main shaft, the gripper cam being engageable with a gripper cam roller coupled to a gripper shaft, rotation of the gripper cam activating a gripper lever coupled to the gripper shaft such that the gripper lever is moveable to the open position to allow the length of wire to pass through and to the closed position to grip the length of wire;

a cutting mechanism configured to cut the length of wire positioned within the twister assembly, wherein the cutting mechanism includes a cutter cam rotatably driven by the main shaft, the cutter cam being engageable with a cutter cam roller coupled to a rocker plate, rotation of the cutter cam actuating the rocker plate into engagement with the length of wire;

an ejector mechanism configured to elect the length of wire from the twister assembly; and a twister shaft driven by a twister motor and operatively coupled to a twisting mechanism, the twister motor being controllable independent from the main shaft motor, the twisting mechanism including a plurality of gears configured to rotate a twister pinion, the twister pinion engaging the length of wire and twisting a portion of the length of wire to form a knot.

8. A twister assembly for use in connection with bundling one or more objects with a length of wire, the twister assembly comprising:

a main shaft driven by a main shaft motor and operatively coupled to:

a gripping mechanism operable between an open and a closed position, wherein the gripping mechanism is selectively configured to be in the open position during feed of the length of wire and, wherein, the gripping mechanism is selectively configured to be in the closed position during tensioning of the length of wire;

a cutting mechanism configured to cut the length of wire positioned within the twister assembly; and an ejector mechanism configured to elect the length of wire from the twister assembly, wherein the ejector mechanism includes an ejector cam rotatably driven by the main shaft, the ejector cam being engageable with an ejector cam roller coupled to an ejector plate, rotation of the ejector cam actuating the ejector plate into engagement with the length of wire; and a twister shaft driven by a twister motor and operatively coupled to a twisting mechanism, the twister motor being controllable independent from the main shaft motor, the twisting mechanism including a plurality of gears configured to rotate a twister pinion, the twister pinion engaging the length of wire and twisting a portion of the length of wire to form a knot.

9. The twister assembly of claim 8 wherein the ejector mechanism includes a second ejector plate and a connector plate to couple the ejector plate and the second ejector plate and, wherein, each ejector plate cooperatively engages the length of wire.

10. A twister assembly for gripping, twisting, cutting, and ejecting a length of wire used in connection with bundling one or more objects, the twister assembly comprising:

a main shaft driven by a main shaft motor, the main shaft including a gripper cam, a cutter cam, and an ejector cam, wherein:

the gripper cam actuates a gripping mechanism operable between an open and a closed position, wherein the gripping mechanism is selectively configured to be in the open position during feed of the length of wire and, wherein, the gripping mechanism is selectively configured to be in the closed position during tensioning of the length of wire;

the cutter cam actuates a cutting mechanism configured to cut the length of wire positioned within the twister assembly; and the ejector cam actuates an ejector mechanism configured to eject the length of wire from the twister assembly; and a twister shaft driven by a twister motor, the twister motor being controllable independent of the main shaft motor, the twister shaft including a drive gear coupled thereto, wherein:

the drive gear actuates a twisting mechanism, the twisting mechanism including a plurality of idler gears driven by the drive gear, the plurality of idler gears configured to rotate a twister pinion engageable with the length of wire to twist a portion of the length of wire to form a knot.

11. The twister assembly of claim 10 further comprising:

a main shaft drive gear rotatably engageable with the drive gear and driven by the twister shaft; and the plurality of idler gears includes a lower idler gear rotatably engageable with the main shaft drive gear and a pair of upper idler gears rotatably engageable with the lower idler gear and the twister pinion, such that rotation of the pair of upper idler gears actuates the twister pinion to form the knot.

12. The twister assembly of claim 10 wherein the twister pinion is slotted to allow the length of wire to pass therethrough.

13. The twister assembly of claim 10 wherein the twisting mechanism is adjustable to selectively increase a number of twists of the portion of the length of wire forming the knot.

14. The twister assembly of claim 10 wherein the twisting mechanism is configured to overtwist the portion of the length of wire forming the knot.

15. The twister assembly of claim 10 wherein the ejector cam is rotatably driven by the main shaft, the ejector cam being engageable with an ejector cam roller coupled to a first ejector plate, rotation of the ejector cam actuating the first ejector plate into engagement with the length of wire.

16. The twister assembly of claim 15 further comprising a second ejector plate and a connector plate to couple the first ejector plate and the second ejector plate and, wherein, the first ejector plate and the second ejector plate cooperatively engage the length of wire.

17. The twister assembly of claim 10 wherein the cutter cam is rotatably driven by the main shaft, the cutter cam being engageable with a cutter cam roller coupled to a rocker plate, rotation of the cutter cam actuating the rocker plate into engagement with the length of wire.

* * * * *